United States Patent [19]

Udagawa

[11] Patent Number: 4,708,685

[45] Date of Patent: Nov. 24, 1987

[54] TOYS

[75] Inventor: Yoshio Udagawa, Ichikawa, Japan

[73] Assignees: Blue Box Toy Factory Limited, Hong Kong; Toplay Limited, Japan

[21] Appl. No.: 861,398

[22] Filed: May 9, 1986

[51] Int. Cl.[4] ..... A63H 33/00; A63H 33/26

[52] U.S. Cl. ..... 446/139; 446/171

[58] Field of Search ..... 446/139, 138, 171, 168, 446/172

[56] References Cited

U.S. PATENT DOCUMENTS

| | | | |
|---|---|---|---|
| 370,305 | 9/1887 | Bartholomew | 446/172 |
| 2,622,366 | 12/1952 | Abplanalp | 446/139 |
| 2,992,512 | 7/1961 | Pettit | 446/138 |
| 3,926,435 | 12/1975 | Nacci | 446/139 X |
| 4,091,561 | 5/1978 | Kimura | 446/171 X |
| 4,128,964 | 12/1978 | Ogasawara | 446/171 |
| 4,609,363 | 9/1986 | Udagawa | 446/171 X |

*Primary Examiner*—Philip C. Kannan

*Attorney, Agent, or Firm*—Pollock, Vande Sande & Priddy

[57] ABSTRACT

A helter-skelter toy having a track-way extending from an upper end to a lower end. A number of baby animal shaped vehicles which can run freely down the track-way. A lifting member in the shape of a mother animal which lifts the vehicles one by one from the lower end to the upper end of the track-way. Means to reciprocate the lifting member between upper and lower ends of the track-way. Magnetic means to engage the vehicles to lift them, these means being retracted through the mouth of the mother animal when the vehicle is aligned with the upper end of the track-way, so ejecting the vehicle and releasing it onto the upper end so that it can run down the track-way.

7 Claims, 6 Drawing Figures

TOYS

This invention relates to a helter-skelter toy and a particular one in which a number of free-wheeling items are lifted one at a time from a lower point to a higher point on a track-way and allowed to run down the track-way under gravity.

BACKGROUND OF THE INVENTION

Various sorts of helter-skelter toy are known and the objective of this invention is to provide a toy where the small vehicles can be of the shape of young animals and the mother of the young animals will appear to pick up these small animals one by the scruff of the neck by one and lift them to the top of the track-way.

BRIEF SUMMARY OF THE INVENTION

According to the invention there is provided a helter-skelter toy comprising an elongated track-way having a generally downwardly directed path so that, when one of a number of baby animal shaped vehicles are placed at the top end, they can run down the track-way under the effect of gravity to a lower end, each of the said vehicles having on its upper portion a magnet, a lifting member in the shape of a mother animal being capable of moving between a lower position where it can pick up one of the baby animal vehicles and an upper position where it can dispose of that vehicle back at the upper end of the track-way, means for reciprocating the lifting member between the two said positions, and magnetic means capable of engaging with the top of a small animal vehicle when the lifting member is in its lowest position and being retracted once the vehicle is positioned above the upper end of the track-way so as to eject that vehicle and release it onto the upper end of the track-way.

Such a toy has considerable novelty appeal in that, when set in motion, the lifting member in the shape of the mother animal will continuously pick up the small animal vehicles one by one and deposit them at the top end of the track-way whence they run down to the bottom to be picked up again by the mother animal lifting member.

Normally the lifting member will be driven by means of electric drive motor through suitable gearing and its movements can be achieved by means of various cams and cam followers. The baby animal vehicles themselves are not independently driven and merely free-wheel down the track-way under the effect of gravity. They are therefore preferably relatively heavy and this can be achieved by, for example, providing them with a pair of metal rollers on which they run so as to ensure that they travel smoothly and progressively down the track-way.

The use of co-operating magnet means between the mouth of the mother animal and the tops of the baby animal vehicles provides a convenient method of temporarily picking up the baby animal vehicles. That magnetic attraction can readily be overcome, however, by withdrawing the magnet means attached to the lifting member through the mouth of the mother animal. The contact with the mouth will eventually physically detach the two magnets from one another and allow the baby animal vehicle to drop onto the upper end of the track-way.

BRIEF DESCRIPTION OF THE DRAWINGS

A helter-skelter toy according to the invention will now be described, by way of example, with reference to the accompanying drawings, in which.

DESCRIPTION OF THE PREFERRED EMBODIMENT

Figure 1:
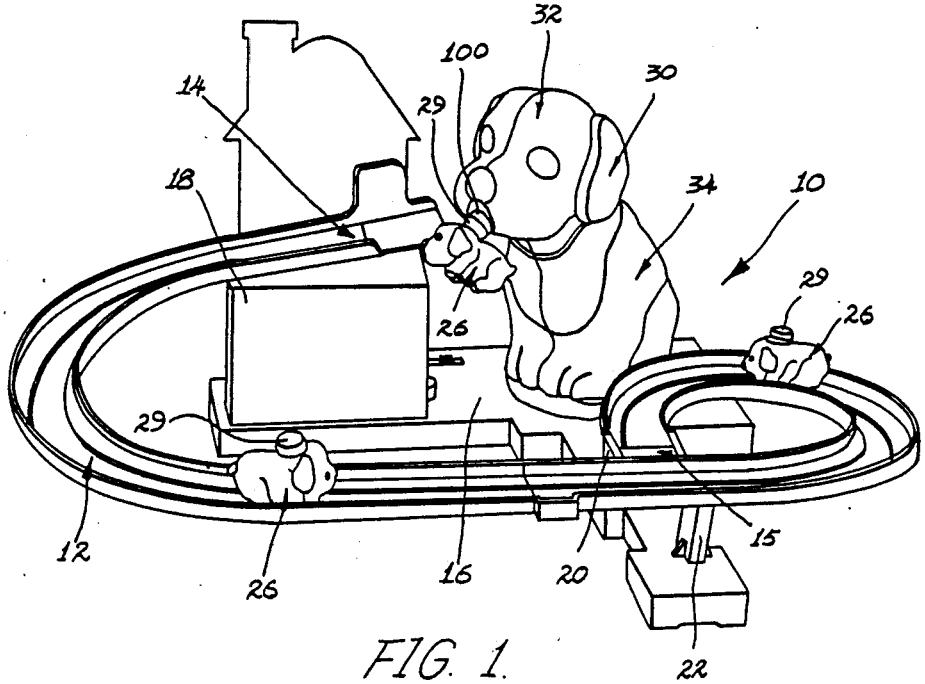
FIG. 1 is a perspective view showing the helter-skelter toy.
Figure 2:
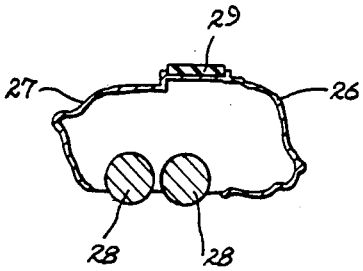
FIG. 2 is a section through one of the baby animals.

The helter-skelter toy 10 as shown in the drawings includes a track-way 12. This is composed of curved and straight sections as shown and extends from an upper end 14 to a lower end 15. The track-way is progressively inclined downwardly from the upper end 14 to the lower end 15.

The track-way is supported on a base 16 by means of a battery housing 18 which supports the upper end 14 and a short pillar 20 supporting the lower end 15. An intermediate pillar 22 supports the track-way at an intermediate position.

Capable of running freely on the track-way are three baby animal vehicles 26. In the embodiment as shown in the drawings, the outer housings 27 of these are in the shape of puppies. These vehicles have a pair of metal rollers 28 on which they run. These rollers are rotatably mounted in the housing 27. At the top of each housing is a small circular magnet 29.

A mother dog-shaped lifter device 30 is mounted on the base 16. This mother dog lifter comprises a head 32 and a body 34. As will be described the head is reciprocatable between an up and a down position. The body 34 for its part is reciprocatable about an upright axis between positions in which the mouth and head are aligned with the upper end 14 and with the lower end 15 of the track-way.

Positioned within the body 34 is a motor and gear box housing 36. This contains an electric motor 38 which drives a number of gears forming a reduction gearing 40. The final output from the reduction gearing drives a shaft 42. The motor is powered from electric batteries (not shown) which are housed in the battery housing 18. A switch 46 is provided to control the operation of the toy 10.

Figure 3:
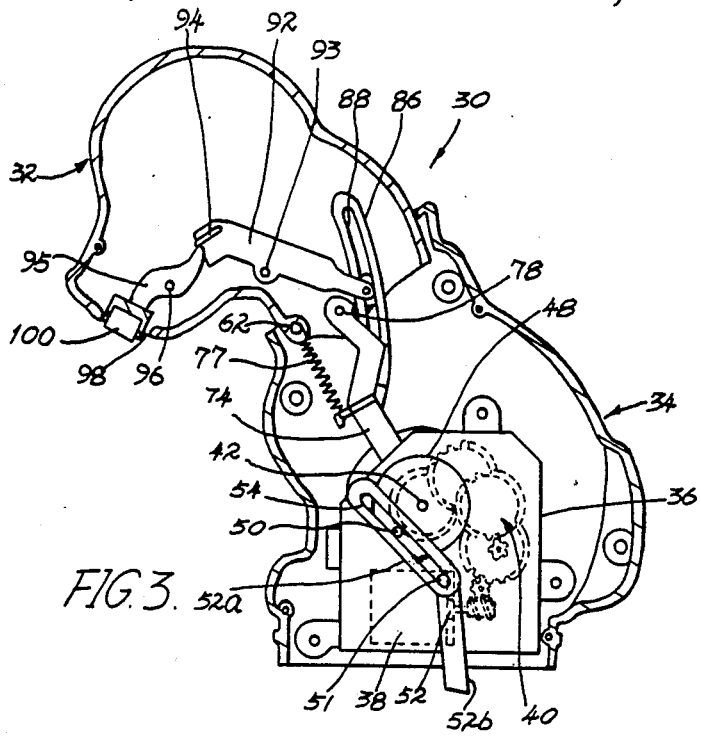
FIG. 3 is a sectional elevation of detail through the mother animal as seen from the right in the sense of FIG. 1.
Figure 4:
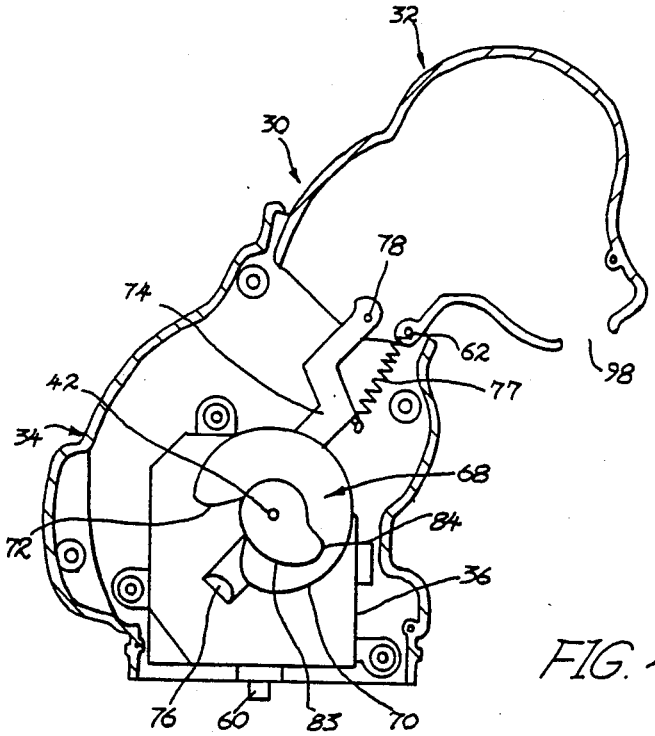
FIG. 4 is a view similar to FIG. 3 but taken as seen from the left in the sense of FIG. 1 with parts controlling the magnet removed for clarity.
Figure 5:
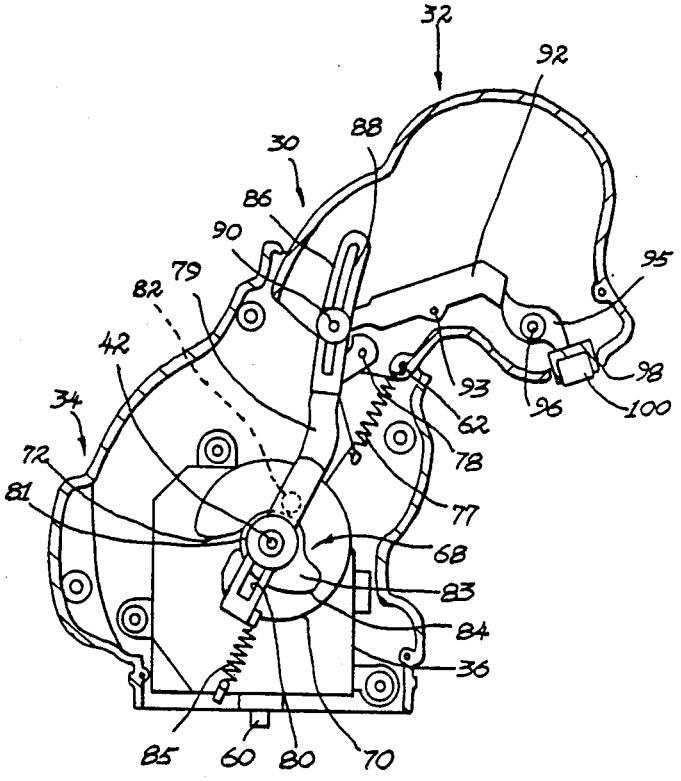
FIG. 5 is a view similar to FIG. 4 without the said parts removed.

The shaft 42 extends out from the housing 36 and, as best shown in FIGS. 3 and 5, a rotatable disc 48 is fixed to it. This has an outwardly projecting cam pin 50. Pivotted to the housing 36 about a pin 51 is a crank 52. One arm **52*a* of this has an elongated slot 54 into which the cam pin 50 projects. The other arm 52*b* of the crank extends downwardly into an elongated curved opening 56 in the base 16. As the shaft 42 rotates the pin travels back and forth within the slot 54 and causes the crank itself to reciprocate. Reciprocation of the arm 52*b* which is engaged in the opening 56 in the base therefore causes the body 34 to twist about its upright axis. This body 34 is itself mounted on an upright shaft 60 (FIG. 4**)

rotatably supported in the base 16. Therefore as the motor is driven the mother dog reciprocates back and forth between the upper and lower ends of the track-way as required. However, because the arm 52*b* engages an elongated opening 56, this reciprocation is not a continuous movement. Thus, the arm 52*b* will only move the body 34 when it presses on one or other end of the slot 54. So, when the body has turned to one limit position, it will remain stationary for a short period whilst the arm 52*b* moves freely to the other end of the slot 54, whereupon it will press on that end and move the body fairly quickly to its other limit position.

Figure 6:
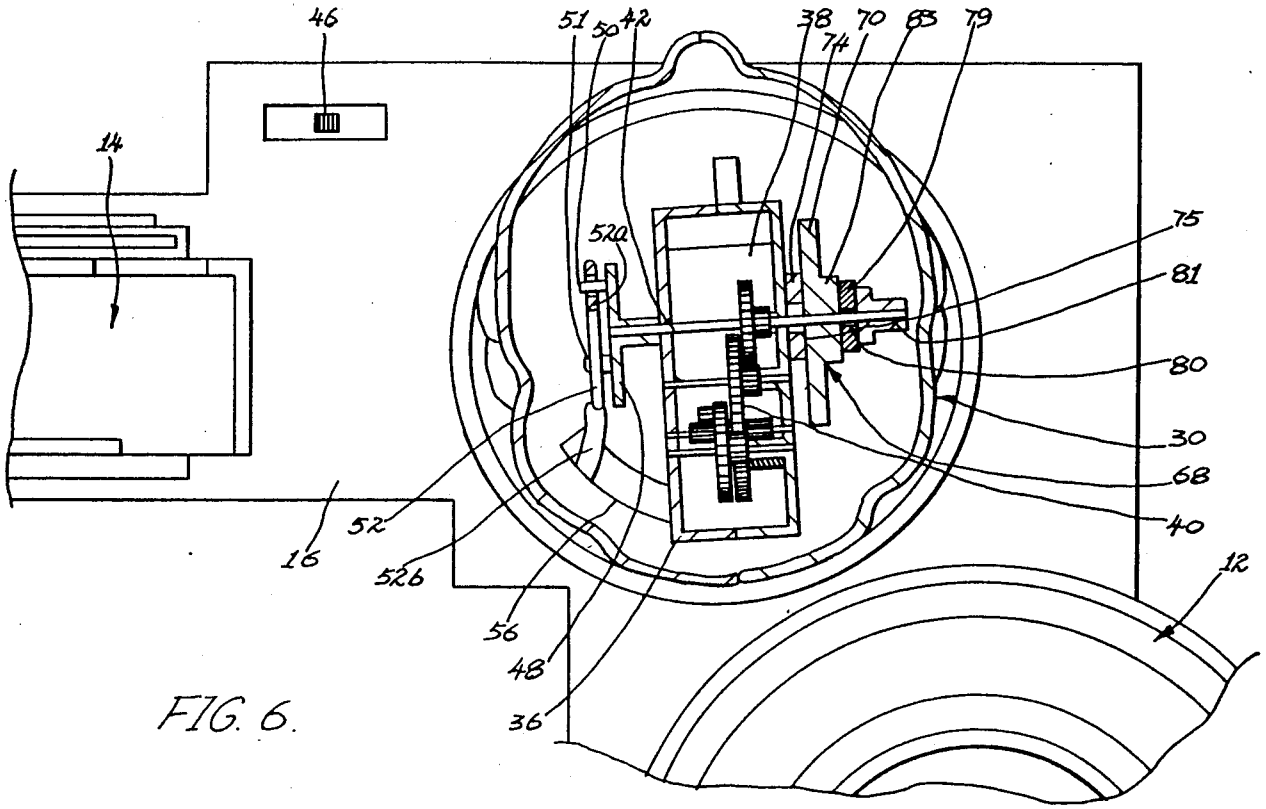
FIG. 6 is an enlarged plan detail through the mother animal body.

Turning now to FIGS. 4 and 6, the head 32 of the dog is pivotally mounted on the body 34 about an axle 62. It is urged to its downward position by gravity.

At its other end, the shaft 42 also projects out from the housing 36 and carries a double cam 68. This includes a first cam disc 70 having a cut-away portion 72. Slidably mounted about the shaft 42 is a lever 74. This lever has a longitudinal slot 75 through which the shaft 42 extends and an upstanding cam-follower 76 at its lower end. This projection engages with the surface of the cam disc 70 and is resiliently urged into contact with it by a spring 77 mounted between the axle 62 and the lever 74. The other end of the lever 74 is rotatably connected to a shaft 78 fixed to the head.

Therefore as the motor rotates the cam 68, the cam follower 76 engages the cam surface of the disc 70 and, except in the cut-away portion 72, draws the lever 74 downwardly relative the shaft 42. This downward movement of the lever pivots the head 32 in an anti-clockwise direction in the sense shown in FIG. 4, i.e. the head is drawn to an upright position. Once the cam-follower 76 reaches the cut-away portion 72, however, the head can begin to lower under the effect of gravity because the lever 74 can now slide in an upward direction so allowing the head to dip. As the cam 68 continues to rotate the cam-follower 76 is again pushed downwardly thus pulling the head up again.

When the portion 72 passes from contact with the cam-follower 76, the relative orientation of the cam 68 and the portion 72 to the cam pin 50 which drives the swivelling of the body 34 relative the base 18, is such that the head 32 is brought to the upright position most of the time with the exception of the period when the body is aligned with the lower end 15 of the track-way. In other words at the time when the head 32 is to be lowered so as to engage one of the vehicles 26.

As best shown in FIGS. 5 and 6, a further sliding lever 79 is mounted on the shaft 42 and has a slot 80 through which the shaft passes. It is held in place by an outer cap 81 mounted on the shaft 42. The lever 79 has an inwardly projecting cam-follower pin 82 engaging a second portion 83 of the double cam 68. The portion 83 has a generally narrow radius except for a relatively short projecting portion 84. The lever 79 is normally urged to a downward position by means of a coil spring 85 mounted between the lower end of the lever and the housing 36.

The lever 79 extends upwardly into the head 32 and has a curved portion 86 with a curved slot 88. Engaged in the slot 86 is a slidable pin 90 at the end of one arm of another crank 92 which is in turn pivotted in the head 32 about a pin 93. The other arm of that crank 92 has a projection 94 engages a further crank 95 pivotted about a pivot rod 96 near the mouth of the head constituted by an opening 98. Aligned with this opening 98 is the other arm of the crank 95. This is enlarged and carries a small magnet 100. When the magnet is in a downward position relative to the head it can engage the magnet 29 on one of the vehicles 26 but, when the magnet is withdrawn into the head relative to the opening 98, the magnet 100 becomes physically disengaged from the magnet 29 on the vehicle 26.

The provision of the curved slot 88 allows the head 32 to reciprocate up and down relative to the body 34, under the effect of the cam 68 and lever 74, but has no effect relatively speaking on the positioning of the cranks 92 and 94. Thus, the head 32 can pivot without in any way moving the magnet 100 which projects through the opening or mouth 98. However, when the head 32 is in the upright position and aligned with the upper end 14 of the track-way, the arrangement is such that the projecting portion 84 will engage the pin 82 and move the lever 79 upwardly against the action of the spring 85. As the head of the dog will at this stage be in an upright position, the pin 90 will quickly approach the lower end of the slot 88, if it is not already in that position, and so as the lever 79 rises, the crank 92 and then the crank 94 pivot so that the magnet 100 is withdrawn through the opening 98. The effect of this is that if one of the vehicles 26 is then being carried by the mother animal, the withdrawal of the magnet 100 will cause the baby animal vehicle 26 to be released and drop onto the upper end 14 of the track-way.

As will be appreciated the overall arrangement for this toy is extremely simple and the operation is very simply controlled by a series of cams which are appropriately aligned with one another. The toy is therefore relatively simple to construct and operate yet very effective and amusing in its operation.

A latitude of modification, change and substitution is intended in the foregoing disclosure and in some instances some features of the invention will be employed without a corresponding use of other features. Accordingly it is appropriate that the appended claims be construed broadly and in a manner consistent with the spirit and scope of the invention herein.

I claim:

1. A helter-skelter toy comprising:

an elongated track-way, said track-way having an upper end and a lower end and following a generally downwardly directed path from said upper end to said lower end, a base supporting said track-way, a number of vehicles each in the shape of a baby animal and each capable of freely running down said track-way from said upper end to said lower end, and each vehicle having an upper portion and a magnet positioned on its upper portion, a lifting member carried by said base, said lifting member being in the shape of a mother animal, said lifting member being movable between a lower position where it can pick up said baby animal vehicle and an upper position where it can deposit that vehicle back at said upper end of said track-way, drive means for reciprocating said lifting member between said lower position and said upper position, magnetic means on said lifting member capable of engaging with said magnet on the top of a vehicle when said vehicle is at said lower end of said track-way and said lifting member is in its lower position to support said vehicle as said lifting member moves to said upper position, means for retracting said magnetic means once said lifting member is in said upper position to eject a vehicle and release it onto said upper end of said track-way and, means mounting said lifting member so as to be movable about an upright axis, and in which said drive means includes a first rotatably driven cam and a crank reciprocated by said first cam and engaging said base for the toy on which said lifting member is mounted.

2. A toy according to claim 1 further comprising a pair of rotatably mounted metal rollers on which each of said baby animal shaped vehicles runs.

3. A toy according to claim 1 further comprising a curved slot in said base in which one arm of said crank engages, rotation of said first cam causing the said one arm of said crank to reciprocate from one end to the other of the curved slot and when it engages an end to the slot it then causes the lifting member to swivel about said upright axis.

4. A toy according to claim 1 in which said lifting member comprises a body and a head pivotably hinged to said body, and further comprising a second rotatably driven cam to control up and down movement of said head relative said body.

5. A toy according to claim 4 further comprising a mouth opening in said head, said magnetic means carried by said head being capable of retracting through said mouth, and a third rotatably driven cam for controlling the retraction of those magnetic means through said mouth.

6. A toy according to claim 5 further comprising a lever 1 moved by said third cam, that said lever being linked to at least one crank carrying said magnetic means through the cooperation of a pin slidable along a slot, whereby said head can be hinged relative said body without withdrawing said magnetic means through said mouth by said pin sliding relative said slot, but when said magnetic means are to be retracted said pin engages one end of said slot.

7. A helter-skelter toy comprising:

an elongated track-way, said track-way having an upper end and a lower end and following a generally downwardly directed path from said upper end to said lower end, a base supporting said track-way and said base including a curved slot, a number of vehicles each in the shape of a baby animal and each capable of freely running down said track-way from said upper end to said lower end, and each vehicle having an upper portion and a magnet positioned on its upper portion, a lifting member carried by said base, said lifting member being in the shape of a mother animal and comprising a body mounted on said base so as to be movable about an upright axis, and a head pivotably hinged to said body, said lifting member being movable between a lower position where it can pick up said baby animal vehicle and an upper position which it can deposit that vehicle back at said upper end of said track-way, drive means for reciprocating said body, said drive means including a first rotatably driven cam and a crank reciprocated by said first cam and engaging said base, said crank having one arm engaging in said curved slot in said base, whereby rotation of said first cam causes the said one arm of said crank to reciprocate from one end to the other of the curved slot and when it engages an end to the slot it then causes said body to swivel about said upright axis, a second rotatably driven cam to control up and down movement of said head relative said body, magnetic means on said lifting member capable of engaging with said magnet on the top of a vehicle when said vehicle is at said lower end of said track-way and said lifting member is in its lower position to support said vehicle as said lifting member moves to said upper position, a mouth opening in said head, means for retracting said magnetic means through said mouth once said lifting member is in said upper position to eject a vehicle and release it onto said upper end of said track-way, said retracting means including a third rotatably driven cam for controlling the retraction of those magnetic means through said mouth, a lever moved by said third cam, that said lever being linked to at least one crank carrying said magnetic means through the cooperation of a pin slidable along a slot, whereby said head can be hinged relative said body without withdrawing said magnetic means through said mouth by said pin sliding relative said slot, but when said magnetic means are to be retracted said pin engages one end of said slot.

* * * * *